US010524588B2

(12) United States Patent
Pratsch

(10) Patent No.: US 10,524,588 B2
(45) Date of Patent: Jan. 7, 2020

(54) CABINET

(71) Applicant: WestRock Container, LLC, Atlanta, GA (US)

(72) Inventor: Jeffrey P. Pratsch, Crystal, MN (US)

(73) Assignee: WestRock Shared Services, LLC, Atlanta, GA (US)

( * ) Notice: Subject to any disclaimer, the term of this patent is extended or adjusted under 35 U.S.C. 154(b) by 97 days.

(21) Appl. No.: 15/433,429

(22) Filed: Feb. 15, 2017

(65) Prior Publication Data

US 2017/0231404 A1 Aug. 17, 2017

Related U.S. Application Data

(60) Provisional application No. 62/295,375, filed on Feb. 15, 2016.

(51) Int. Cl.
*A47F 5/11* (2006.01)
*A47B 43/02* (2006.01)

(52) U.S. Cl.
CPC ..... *A47F 5/116* (2013.01); *A47B 43/02* (2013.01)

(58) Field of Classification Search
CPC ..... A47F 5/116; A47B 43/02
See application file for complete search history.

(56) References Cited

U.S. PATENT DOCUMENTS 3,628,842 A * 12/1971 Wright ..... A47B 43/02 312/234
4,311,100 A 1/1982 Gardner
5,315,936 A 5/1994 Smith
5,443,168 A * 8/1995 Dyment ..... A47F 5/116 211/149
6,244,194 B1 6/2001 Salmanson
6,607,199 B2 8/2003 Gruber
6,609,466 B2 8/2003 Salmanson
6,612,669 B2 * 9/2003 Grueneberg ..... A47B 43/02 108/165
6,715,623 B2 4/2004 Broerman
6,722,292 B2 4/2004 Salmanson
6,752,280 B2 6/2004 Dye
6,857,642 B2 2/2005 Gruber
6,925,943 B2 8/2005 Salmanson
7,007,615 B2 * 3/2006 Grueneberg ..... A47B 43/02 108/165
7,104,553 B2 9/2006 Gruber
7,159,521 B2 1/2007 Salmanson
7,677,433 B2 3/2010 Little
7,703,864 B2 4/2010 Moser
7,905,365 B2 3/2011 Virvo
8,286,809 B2 10/2012 Mestres Armengol
8,292,082 B2 10/2012 Bowman
8,485,370 B2 7/2013 Dewhurst
8,833,573 B2 9/2014 Tomaszewski
8,857,633 B2 * 10/2014 Dewhurst ..... A47F 5/116 211/135

(Continued)

FOREIGN PATENT DOCUMENTS

DE 102011116238 A1 * 4/2013 ..... B65D 5/52
DE 202014106151 U1 * 2/2015 ..... A47F 5/116

*Primary Examiner* — Stanton L Krycinski
(74) *Attorney, Agent, or Firm* — WestRock IP Legal

(57) ABSTRACT

A cabinet includes a plurality of vertically spaced-apart shelves adapted to hold product for display in a retail location. The cabinet is formed from a blank which is folded to form the cabinet.

20 Claims, 18 Drawing Sheets

(56) References Cited

U.S. PATENT DOCUMENTS

| | | | | |
|---|---|---|---|---|
| 9,211,021 | B2 * | 12/2015 | Smith | A47F 5/116 |
| 9,844,282 | B2 * | 12/2017 | Smith | A47F 5/116 |
| 9,907,414 | B2 * | 3/2018 | Heuer | A47B 43/00 |
| 9,949,579 | B1 * | 4/2018 | Frost | A47F 5/116 |
| 2004/0148825 | A1 * | 8/2004 | Myers | A47F 5/116<br>40/124 |
| 2013/0264923 | A1 | 10/2013 | Brady | |
| 2017/0238727 | A1 * | 8/2017 | Ertl | B65D 5/5226 |

* cited by examiner

CABINET

PRIORITY CLAIM

This application claims priority under 35 U.S.C. § 119(e) to U.S. Provisional Application Ser. No. 62/295,375, filed Feb. 15, 2016, which is expressly incorporated by reference herein.

BACKGROUND

The present disclosure relates to a cabinet, and particularly to a cabinet having shelves. More particularly, the present disclosure relates to a cabinet formed from a blank of a corrugated material folded to form the cabinet.

SUMMARY

According to the present disclosure, a cabinet includes a plurality of vertically spaced-apart shelves adapted to hold product for display in a retail location. A blank of corrugated material is folded to form the cabinet.

In illustrative embodiments, a cabinet includes a body formed to include an insert-receiving space therein and an insert. The body includes a pair of sidewall panels spaced apart from one another, a back wall panel extending between the sidewall panels, and a body shelf-part strip extending between the sidewall panels and spaced apart from the back wall panel. The insert includes a pair of spacer panels spaced apart from one another and an insert shelf-part strip extending between the spacer panels. The insert is located in the insert-receiving space and arranged to cause the spacer panels to extend along the side walls and the insert shelf-part strip to be generally parallel with the body shelf-part strip.

In illustrative embodiments, the insert shelf-part strip of the insert includes a plurality of first shelf parts. The back wall panel of the body is formed to include a plurality of slots. The spacer panels cooperate with the back wall panel to position the first shelf parts relative to the back wall panel. Support tabs included in the first shelf parts are received in and engage the slots of the back wall panel. The body shelf-part strip of the body includes a plurality of second shelf parts. The second shelf parts mate with the first shelf parts to establish shelves included in the cabinet.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
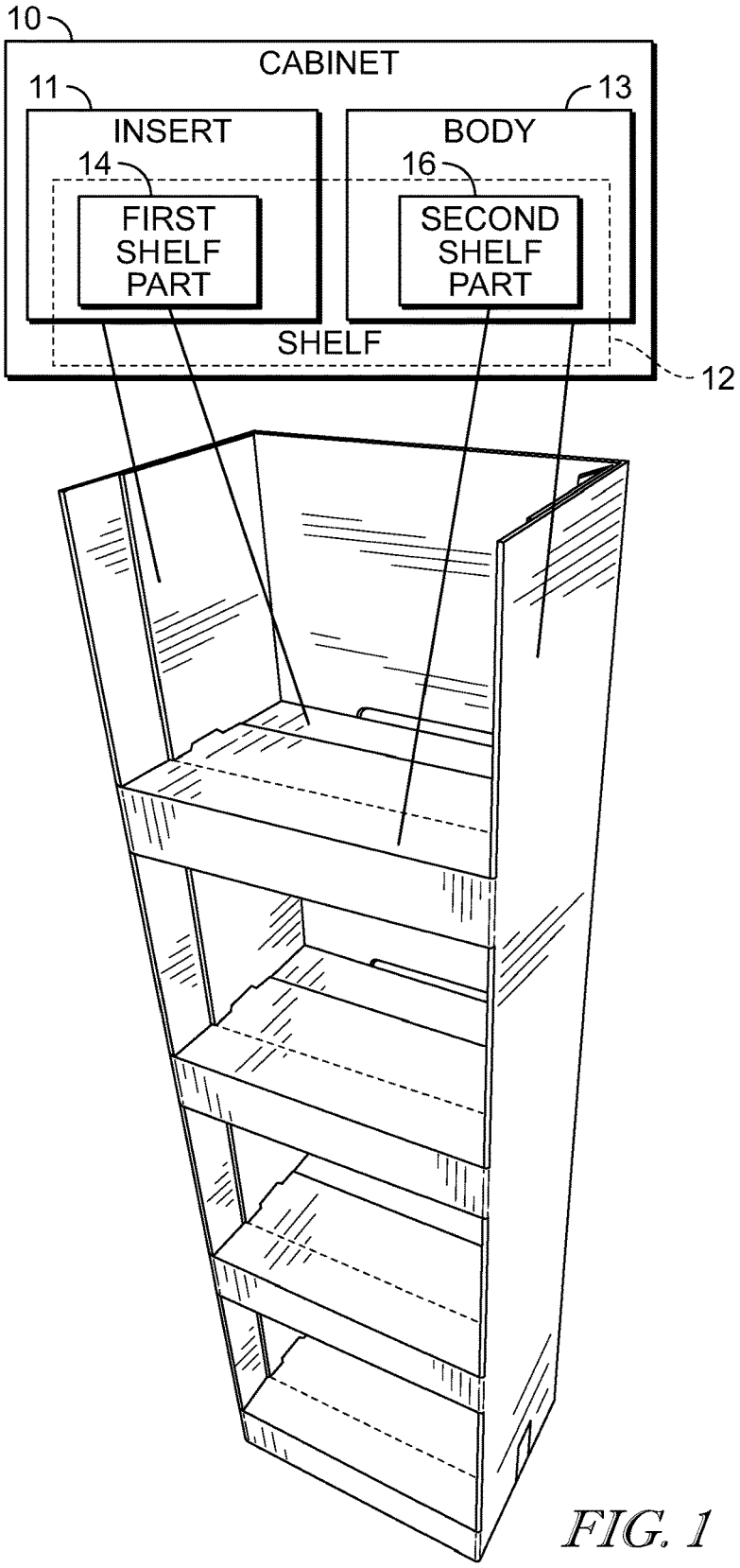
FIG. 1 is a front perspective view of a cabinet in accordance with the present disclosure showing that the cabinet includes a body and an insert that cooperate to define a plurality of vertically spaced-apart shelves adapted to hold product for display in a retail location and suggesting that the shelves are formed from a first shelf part of the insert and a second shelf part of the body.
Figure 2:
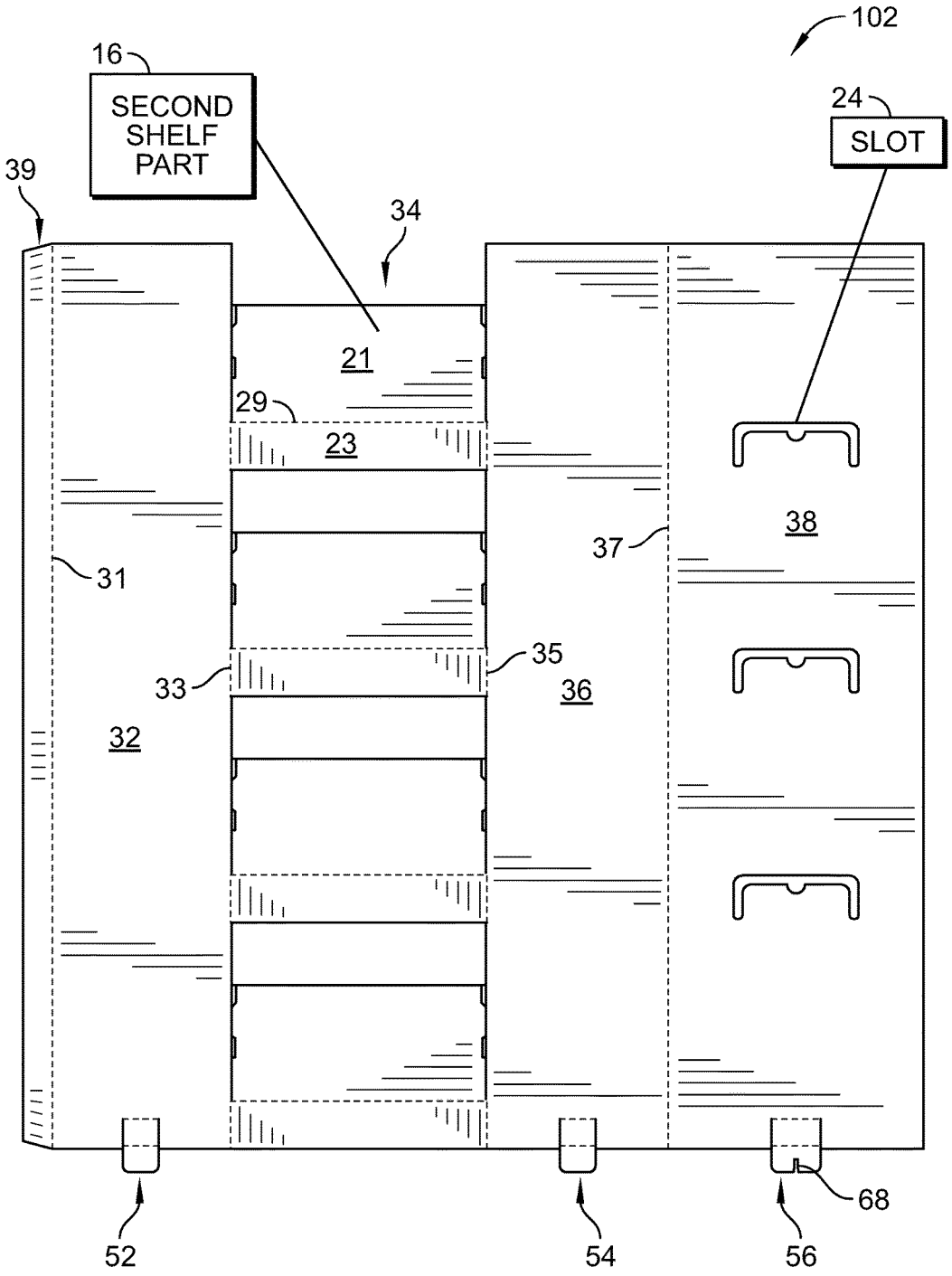
FIG. 2 is a top plan view of an embodiment of a body blank in accordance with the present disclosure used to form the body of the cabinet of FIG. 1 showing that the body blank includes sidewall panels, a back wall panel, and a body shelf-part strip defining a plurality of second shelf parts and suggesting that the panels and strip fold relative to one another to form the tubular body.
Figure 3:
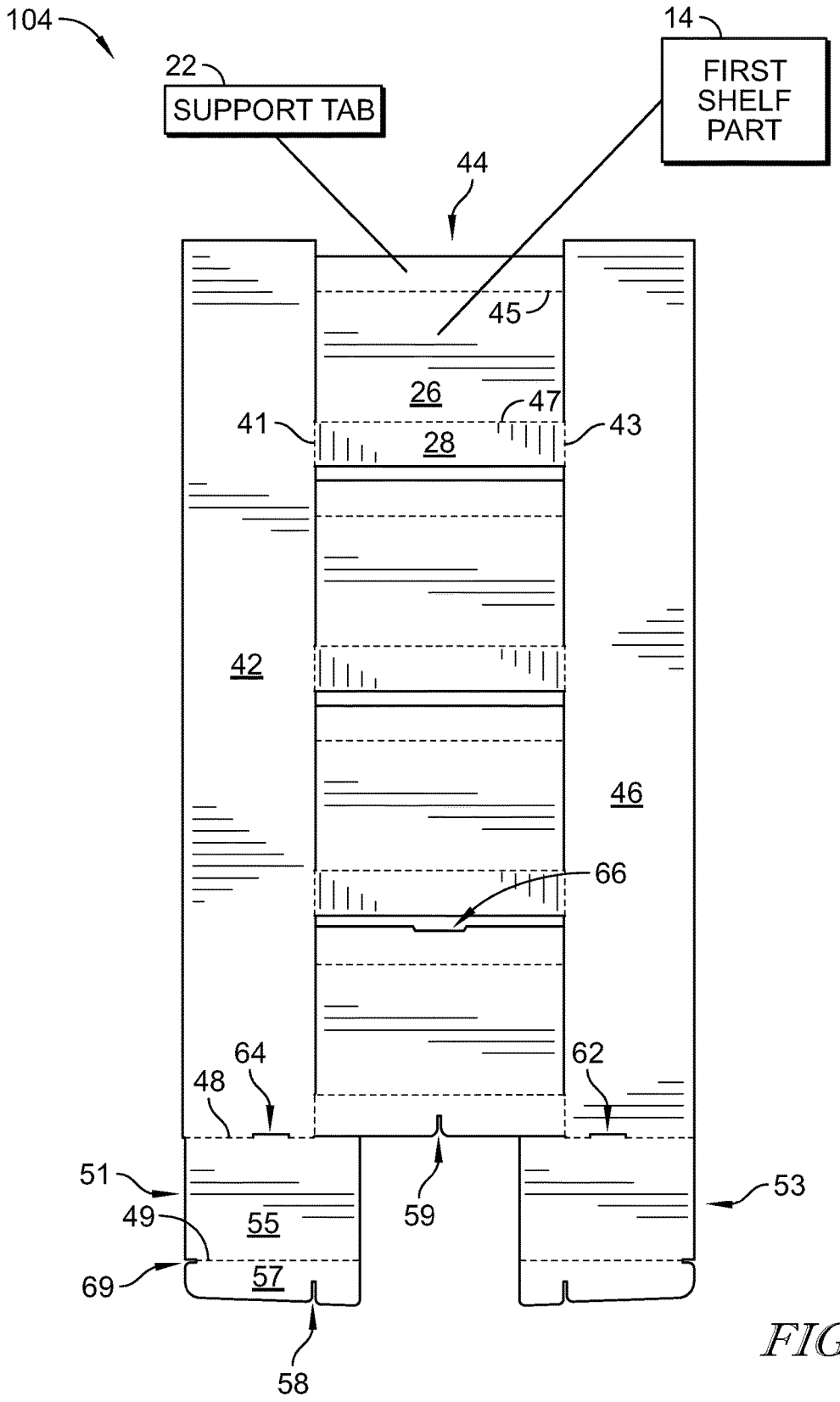
FIG. 3 is a top plan view of an embodiment of an insert blank in accordance with the present disclosure used to form the insert of the cabinet of FIG. 1 showing that the insert blank includes a spacer panels and an insert shelf-part strip defining a plurality of first shelf parts and suggesting that the spacer panels and strip fold relative to one another to form the insert.
Figure 19:
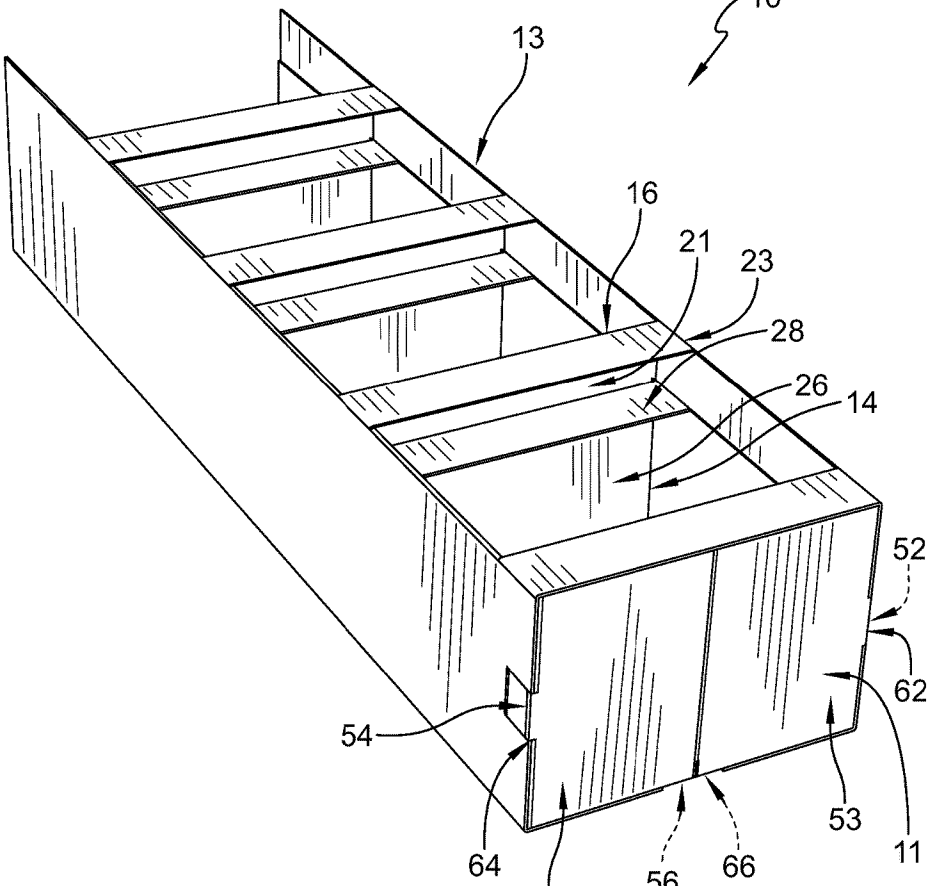
FIG. 19 is a lower perspective view of the cabinet of FIG. 18 showing the bottom-closure flaps defining a closed bottom of the cabinet.
Figure 18:
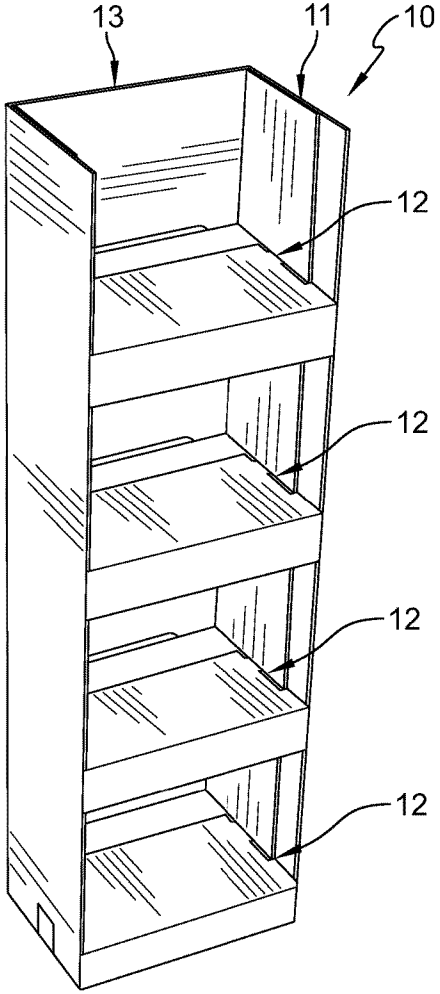
FIG. 18 is a view similar to FIG. 17 showing the remaining shelf parts folded to form the remaining shelves to assemble the cabinet.
Figure 21:
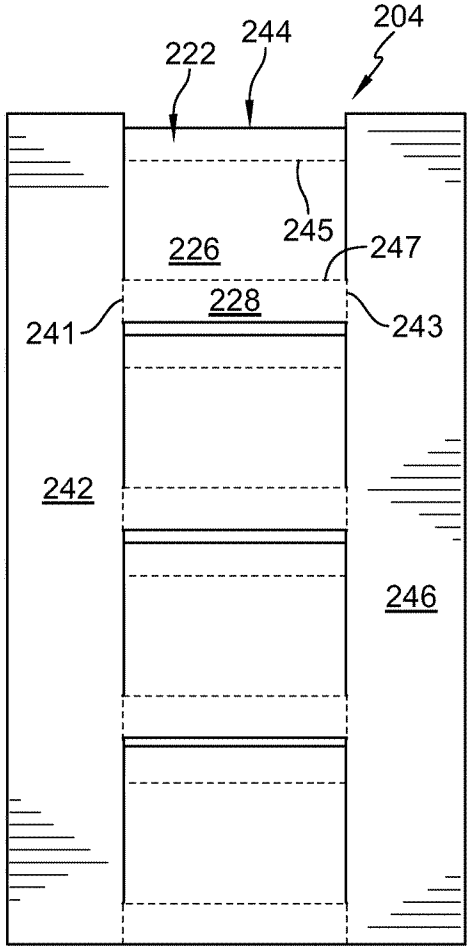
FIG. 21 is a top plan view of another embodiment of an insert blank in accordance with the present disclosure.
Figure 20:
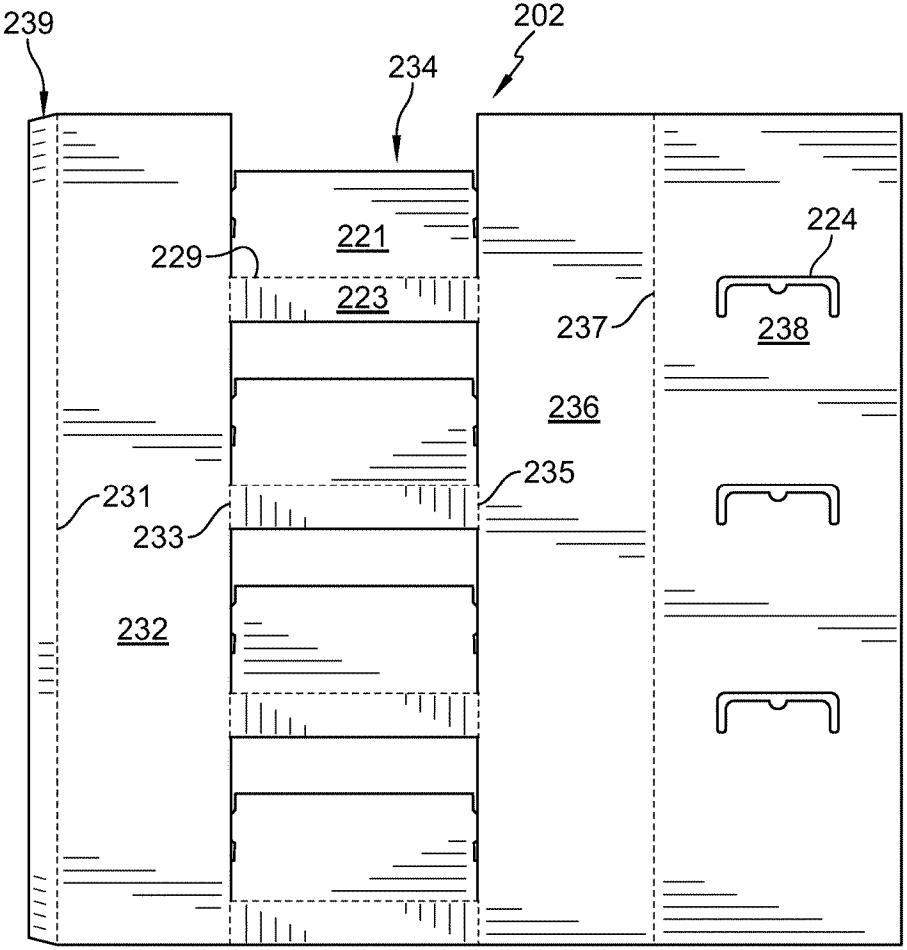
FIG. 20 is a top plan view of another embodiment of a body blank in accordance with the present disclosure.
Figure 23:
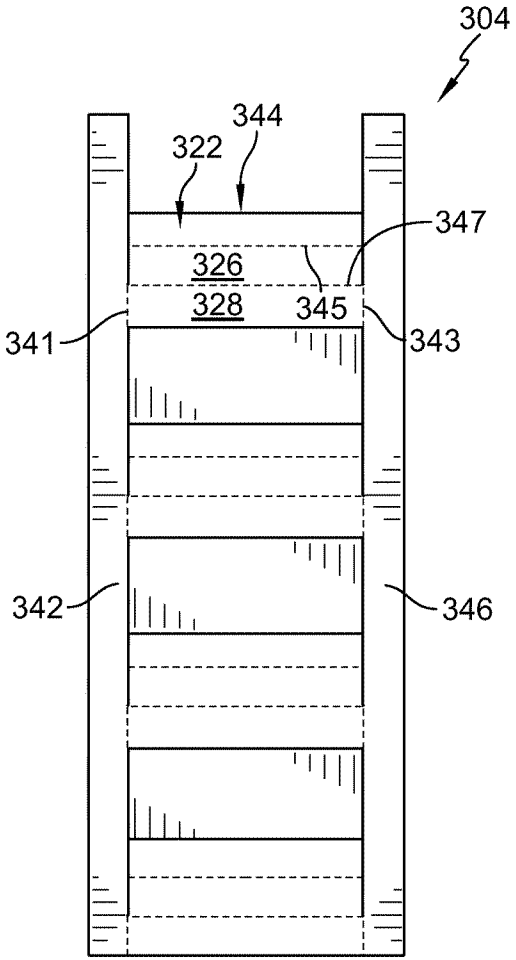
FIG. 23 is a top plan view of another embodiment of an insert blank in accordance with the present disclosure.
Figure 22:
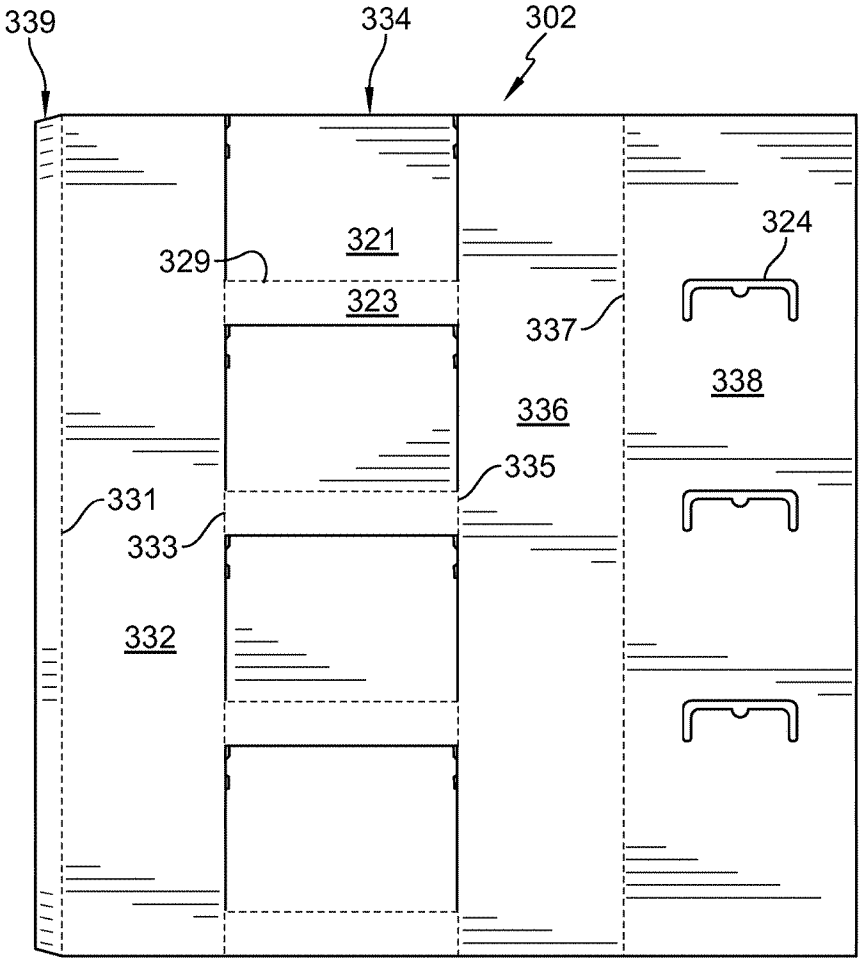
FIG. 22 is a top plan view of another embodiment of a body blank in accordance with the present disclosure.
Figure 25:
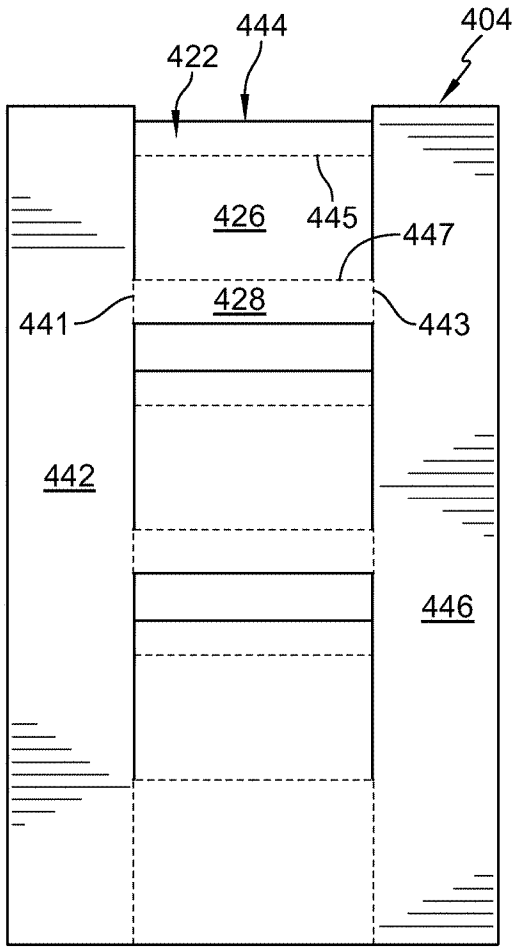
FIG. 25 is a top plan view of another embodiment of an insert blank in accordance with the present disclosure.
Figure 24:
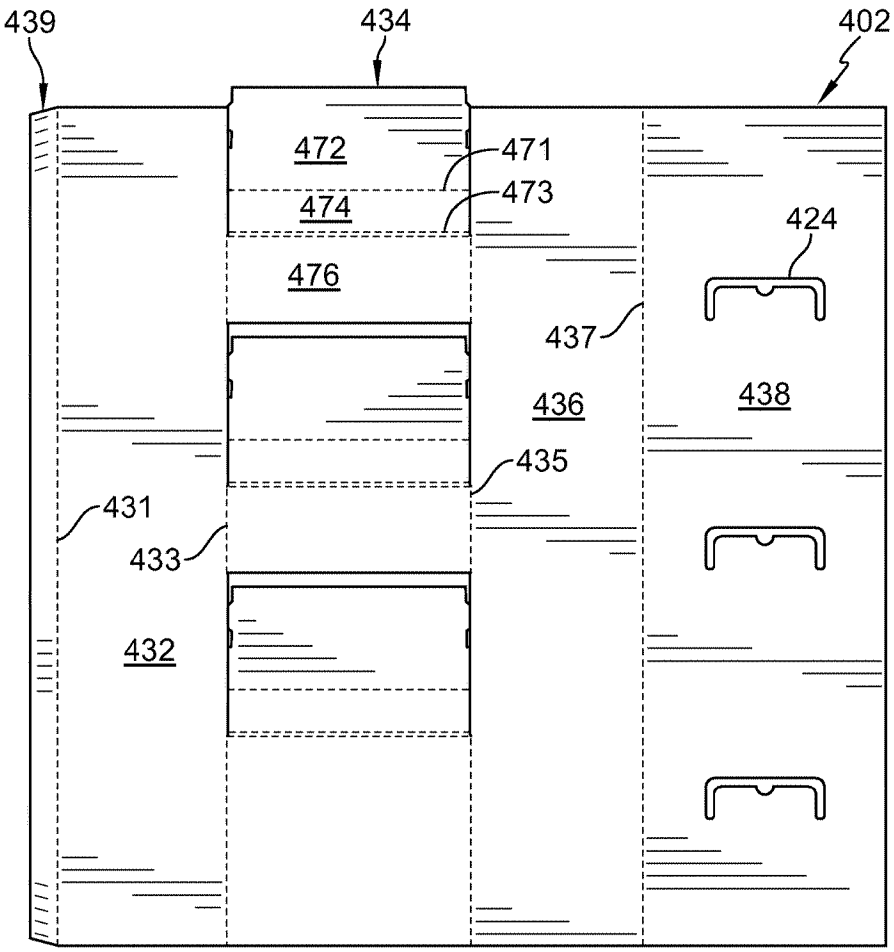
FIG. 24 is a top plan view of another embodiment of a body blank in accordance with the present disclosure.
Figure 27:
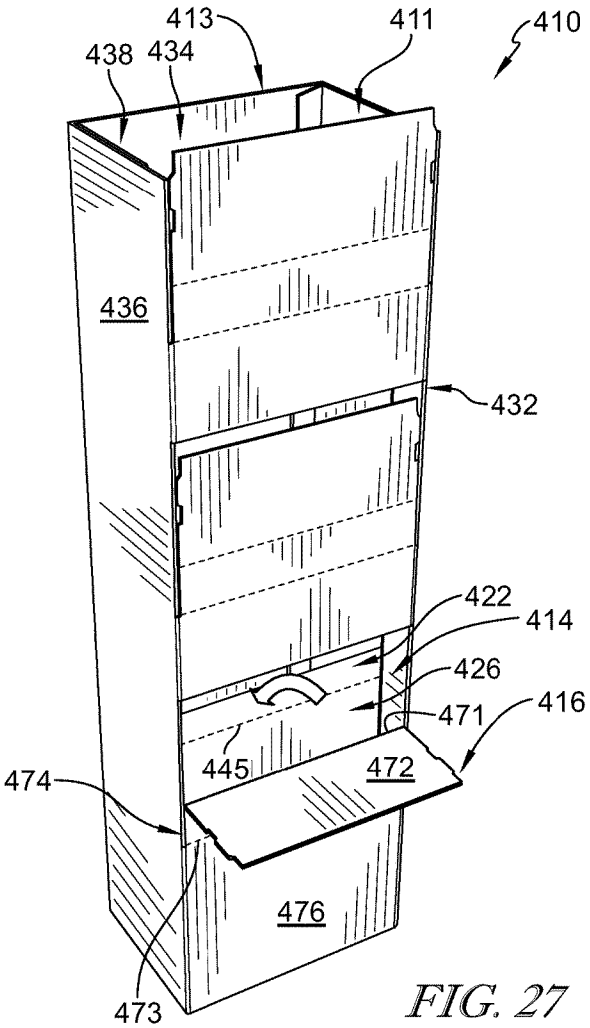
FIG. 27 is a view similar to FIG. 26 showing the second floor panel folded over and suggesting that a support tab of a first shelf part folds relative to a first floor panel as shown in FIG. 28.
Figure 31:
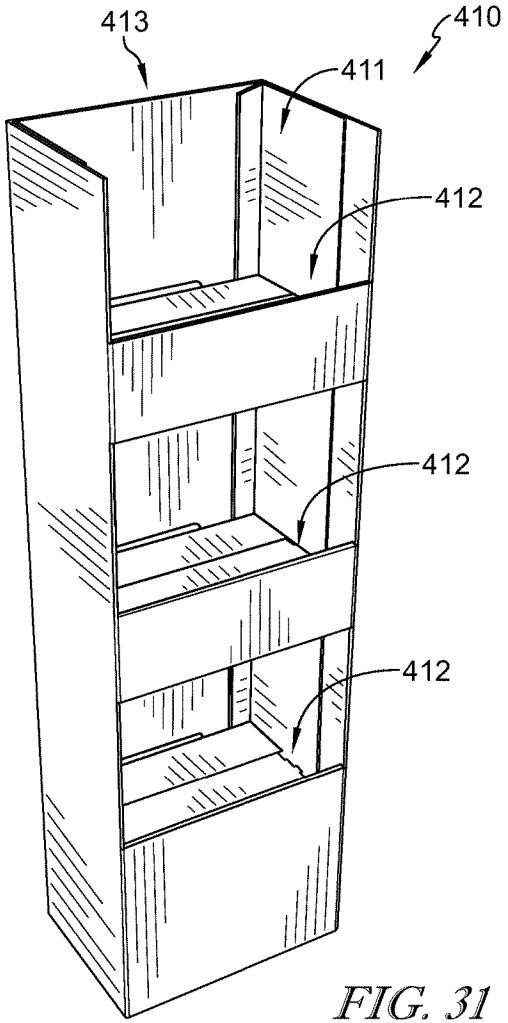
FIG. 31 is a view similar to FIG. 30 showing the remaining shelf parts folded to form the remaining shelves to assemble the cabinet.
Figure 30:
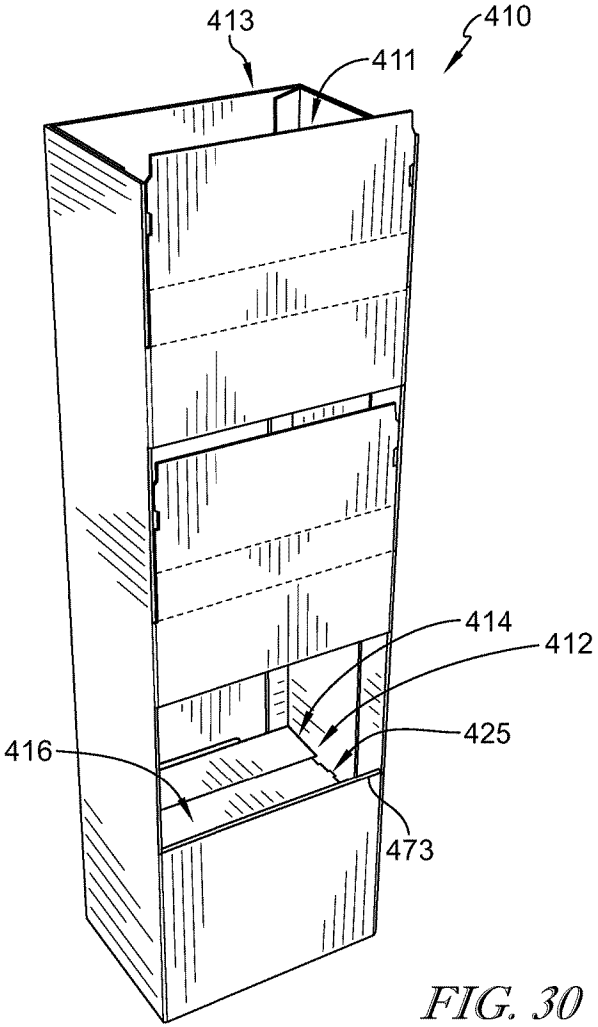
FIG. 30 is a view similar to FIG. 29 showing the second floor panel received on the first floor panel to define a recessed shelf and suggesting that a lip is formed along the second fold line of the second shelf part to block product stored on the shelf from falling out of the cabinet.

One embodiment of a cabinet 10 in accordance with the present disclosure is shown in FIGS. 1, 18, and 19. A body blank 102 and an insert blank 104 used to form cabinet 10 are shown in FIGS. 2 and 3 respectively. A method of using body blank 102 and insert blank 104 to form cabinet 110 is shown in FIGS. 4-17. Another embodiment of a body blank 202 and an insert blank 204 used to make a cabinet in accordance with the present disclosure is shown in FIGS. 20 and 21 respectively. Another embodiment of a body blank 302 and an insert blank 304 used to make a cabinet in accordance with the present disclosure is shown in FIGS. 22 and 23 respectively. Another embodiment of a body blank 402 and an insert blank 404 used to make a cabinet in accordance with the present disclosure is shown in FIGS. 24 and 25 respectively. Another embodiment of a cabinet 410 made using body blank 402 and insert blank 404 is shown in FIG. 31. A method of using body blank 402 and insert blank 404 to form cabinet 410 is shown in FIGS. 26-30.

Cabinet 10 in accordance with the present disclosure is shown in FIG. 1. Cabinet 10 includes a plurality of vertically spaced-apart shelves 12 adapted to hold product for display in a retail location. Each shelf 12 is formed from at least two shelf parts 14, 16. Cabinet 10 is formed as a result of coupling an insert 11 with a tubular body 13 as suggested in FIGS. 9-19. Body 13 is formed by erecting a body blank 102. Insert 11 is formed by erecting an insert blank 104. Blanks 102 and 104 are made, for example, of corrugated material. As shown and described herein, when making reference to a blank of material, solid lines denote a cut line where adjacent portions of material are severed from one another and dashed lines denote a fold line where portions of material are folded relative to one another. In some examples, fold lines are scored or perforated.

Body blank 102 includes two sidewall panels 32, 36 coupled to a body shelf-part strip 34, and a back wall panel 38 coupled to sidewall panel 36 as shown in FIG. 2. In some embodiments, back wall panel 38 is coupled to sidewall panel 32. Body shelf-part strip 34 is formed to define a plurality of second shelf parts 16 corresponding to a number of shelves in the assembled cabinet 10. Back wall panel 38 is formed to include a plurality of slots 24. Sidewall panels 32, 36 provide lateral walls of body 13, body shelf-part strip provides a front wall of body 13, and back wall panel 38 provides a back wall of body 13 as suggested in FIG. 9. Panels 32, 36, 38 and body shelf-part strip 34 fold relative to one another to form body 13, and a retainer flap 39 engages with panel 38 to retain body 13 in a folded position as suggested in FIGS. 4-6. In some embodiments, an adhesive material couples retainer flap 39 to panel 38.

In the illustrative embodiment, insert blank 104 includes spacer panels 42, 46 coupled to an insert shelf-part strip 44 as shown in FIG. 3. Insert shelf-part strip 44 is formed to define a plurality of first shelf parts 11. Bottom-closure flaps 51, 53 are coupled to spacer panels 42, 46 and configured to fold relative to define a closed bottom of cabinet 10 as suggested in FIGS. 10, 11, and 19. Panels 42, 46, insert shelf-part strip 44, and flaps 51, 53 fold relative to one another to form insert 11 as suggested in FIGS. 8, 10, and 11.

Each first shelf part 14 of insert shelf-part strip 44 includes a support tab 22, a first floor panel 26, and a support wall band 28 as shown in FIG. 3. Support tab 22 is foldable relative to first floor panel 26 about a fold line 45 and first floor panel 26 is foldable relative to support wall band 28 about a fold line 47. Each second shelf part 16 of body shelf-part strip 34 includes a second floor panel 21 and a front wall band 23 as shown in FIG. 2. Second floor panel is foldable relative to front wall band 23 about a fold line 29. Back wall panel 38 is formed to include slots 24. Slots 24 are configured to receive support tabs 22 of first shelf parts 14 to support first floor panel 26 relative to back wall panel 38 as suggested in FIG. 16.

Figure 4:
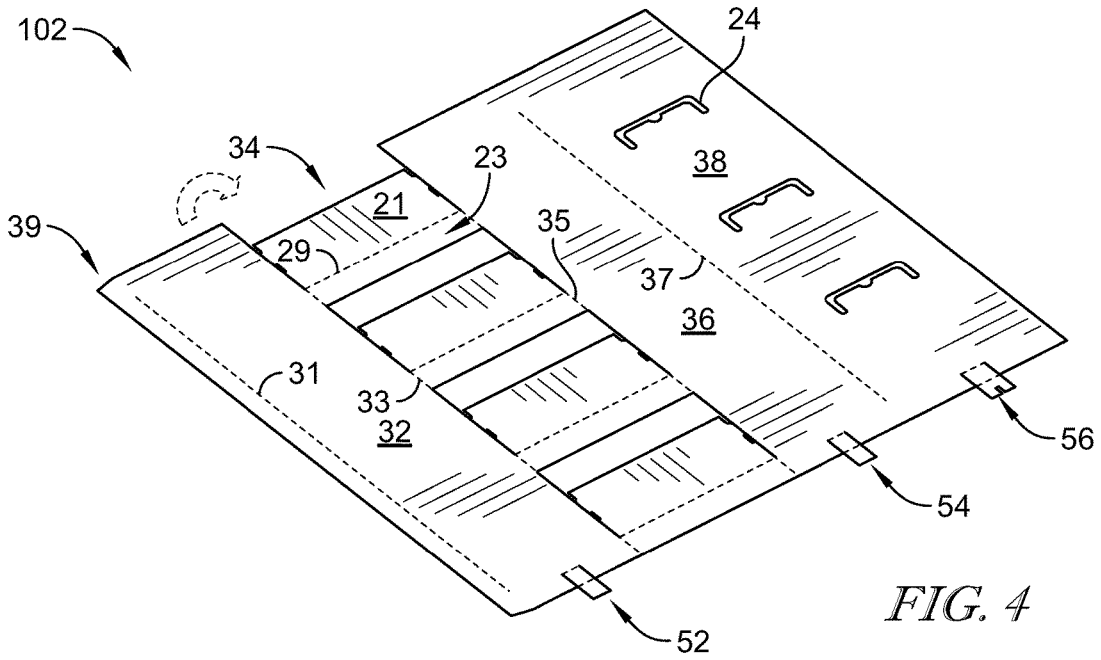
FIG. 4 is an upper perspective view of the body blank of FIG. 2 showing the panels and strip coplanar to one another prior to folding and suggesting that one of the sidewall panels is configured to fold relative to the body shelf-part strip as shown in FIG. 5.
Figure 5:
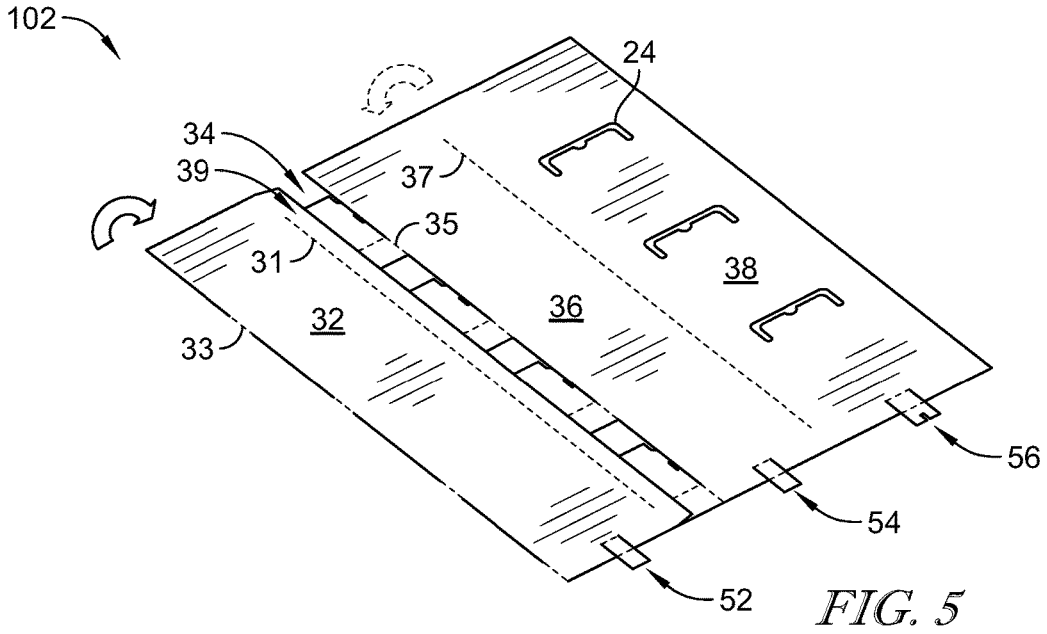
FIG. 5 is a view similar to FIG. 4 showing the sidewall panel folded over the body shelf-part strip and suggesting that a retainer flap is configured to receive an adhesive material and engage with the back wall panel to attach with the back wall panel when the back wall panel fold relative to the other sidewall panel as shown in FIG. 6.
Figure 6:
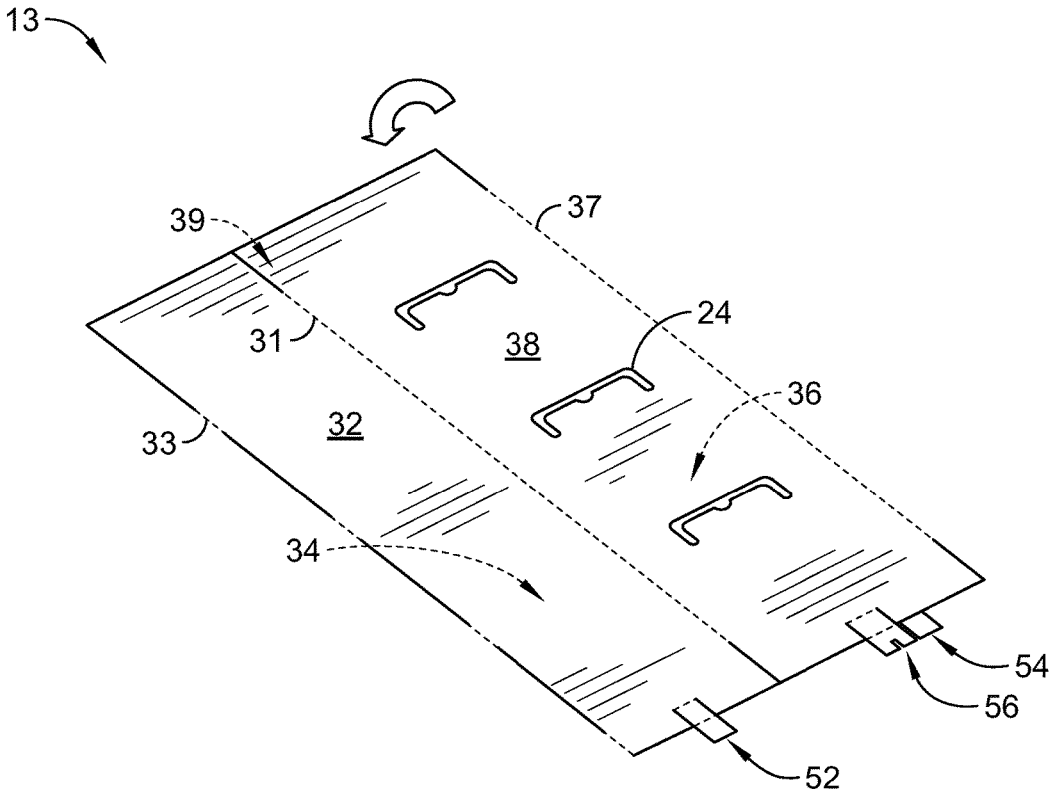
FIG. 6 is an upper perspective view of the body of FIG. 1 showing the body in a collapsed-flat position after engagement of the back wall panel with the retainer flap.

Retainer flap 39 is foldable relative to sidewall panel 32 about a fold line 31 as suggested in FIG. 4. To erect body 13 from body blank 102, sidewall panel 32 is folded relative to body shelf-part strip 34 about a fold line 33 which runs substantially along an entire edge of sidewall panel 32 as suggested in FIGS. 4 and 5. In one example, adhesive is added to retainer flap 39 and back wall panel 38 is folded relative to sidewall panel 36 about a fold line 37 to engage with retainer flap 39 as suggested in FIGS. 5 and 6. Sidewall panel 36 is folded relative to body shelf-part strip 34 about a fold line 35 which runs substantially along an entire edge of sidewall panel 36 as suggested in FIG. 7. Body 13 is shown in a collapsed-flat position in FIGS. 6 and 7. In some embodiments, body 13 is shipped in the collapsed-flat position with insert blank 104 to be assembled together into cabinet 10 by a user. In some embodiments, cabinet 10 is assembled before shipping.

Figure 7:
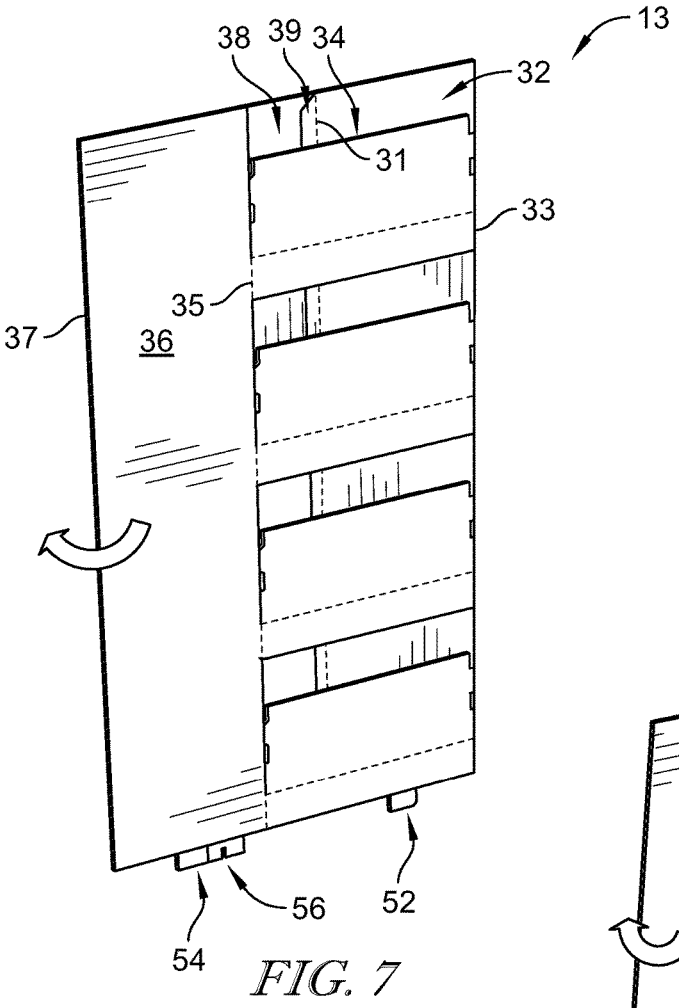
FIG. 7 is a front perspective view of the body of FIG. 6 showing the body in the collapsed-flat position and suggesting that a user folds the sidewall panels relative to the back wall panel to move the body to an expanded-assembly position as shown in FIG. 9.
Figure 8:
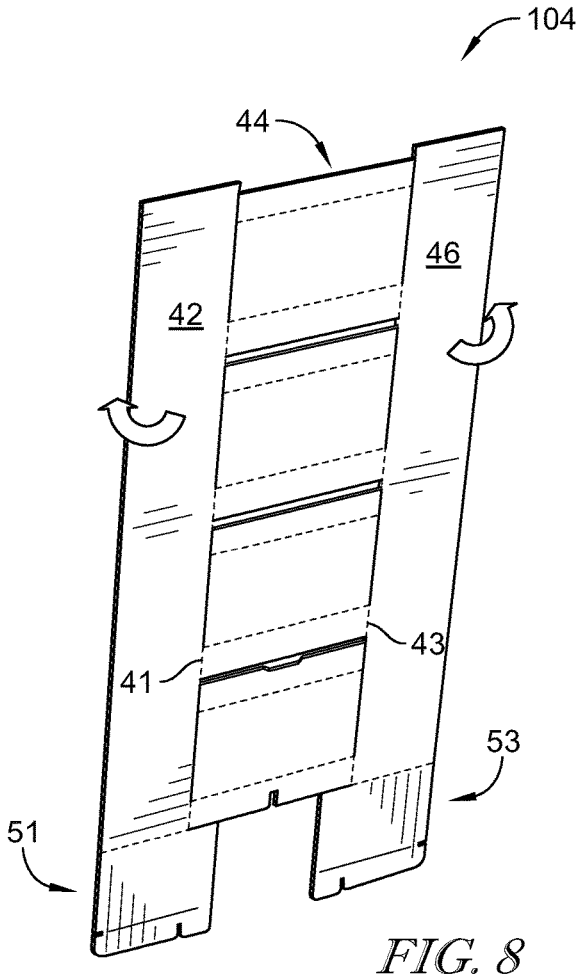
FIG. 8 is a front perspective view of the insert blank of FIG. 3 showing the spacer panels and strip coplanar to one another prior to folding and suggesting that the spacer panels are configured to fold relative to the insert shelf-part strip for erecting the insert as shown in FIG. 10.
Figure 9:
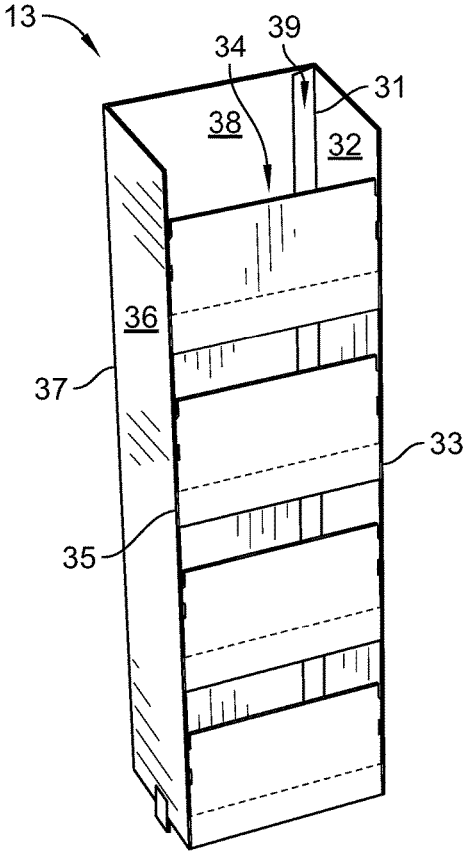
FIG. 9 is a view similar to FIG. 7 showing the body in the expanded-assembly position such that the sidewall panels are spaced apart from one another and the back wall is spaced apart from the body shelf-part strip to define a tube for receiving the insert as suggested in FIG. 11.
Figure 10:
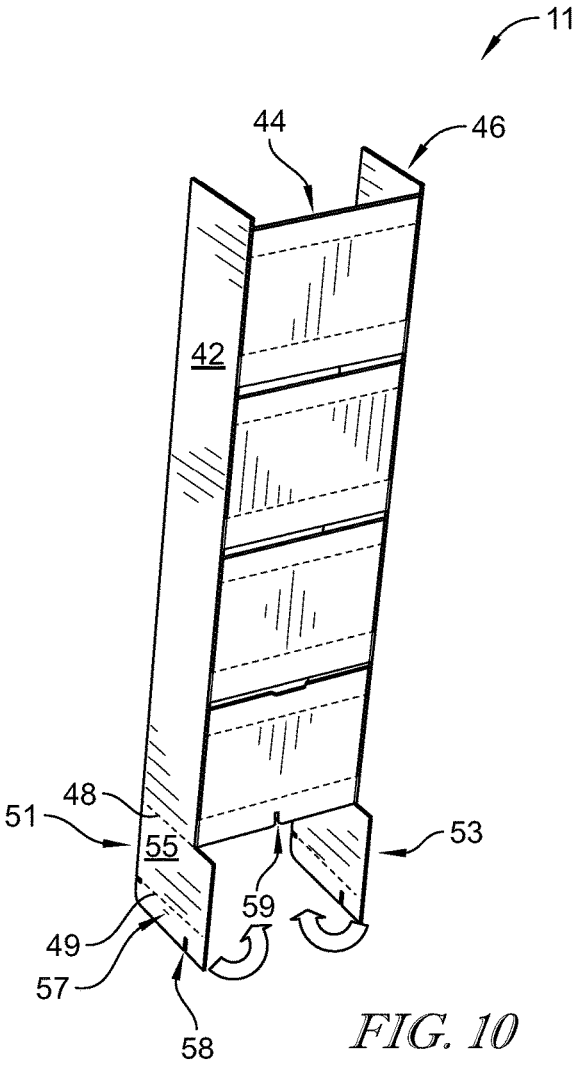
FIG. 10 is a view similar to FIG. 8 showing the insert partially erected and suggesting that bottom-closure flaps fold relative to spacer panels to define a closed bottom of the cabinet as suggested in FIG. 19.

Body 13 is moved along fold lines 31, 33, 35, 37 to open body 13 from the collapsed-flat position, shown in FIG. 7, to an expanded assembly position, shown in FIG. 9. Sidewall panels 32, 36 are spaced apart from one another, and body shelf-part strip 34 is spaced apart from back wall panel 38 when body 13 is in the expanded-assembly position. Spacer panels 42, 46 are folded relative to insert shelf-part strip 44 about fold lines 41, 43 to partially erect insert 11 as suggested in FIGS. 8 and 10. Bottom-closure flaps 51, 53 each include a base panel 55 and a wedge flap 57 as shown in FIG. 10. Base panels 55 fold relative to sidewall panels 42, 46 about fold lines 48, and wedge flaps 57 fold relative to base panels 55 about fold lines 49, such that notches 58 of bottom closure flaps 51, 53 engage with a notch 59 of the insert shelf-part strip 44 to define a closed bottom for cabinet 10 as suggested in FIGS. 10 and 11.

Figure 11:
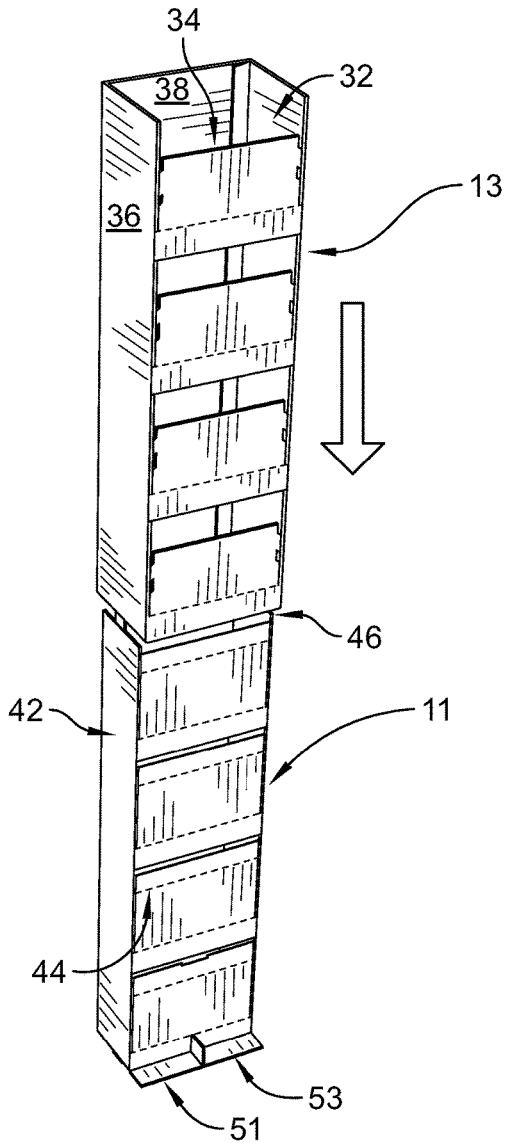
FIG. 11 is a front perspective view of the body positioned over the insert showing that the body is sized to receive the insert and suggesting that the spacer panels engage with the back wall to space the insert shelf-part strip apart from the back wall panel and apart from the body shelf-part strip.
Figure 12:
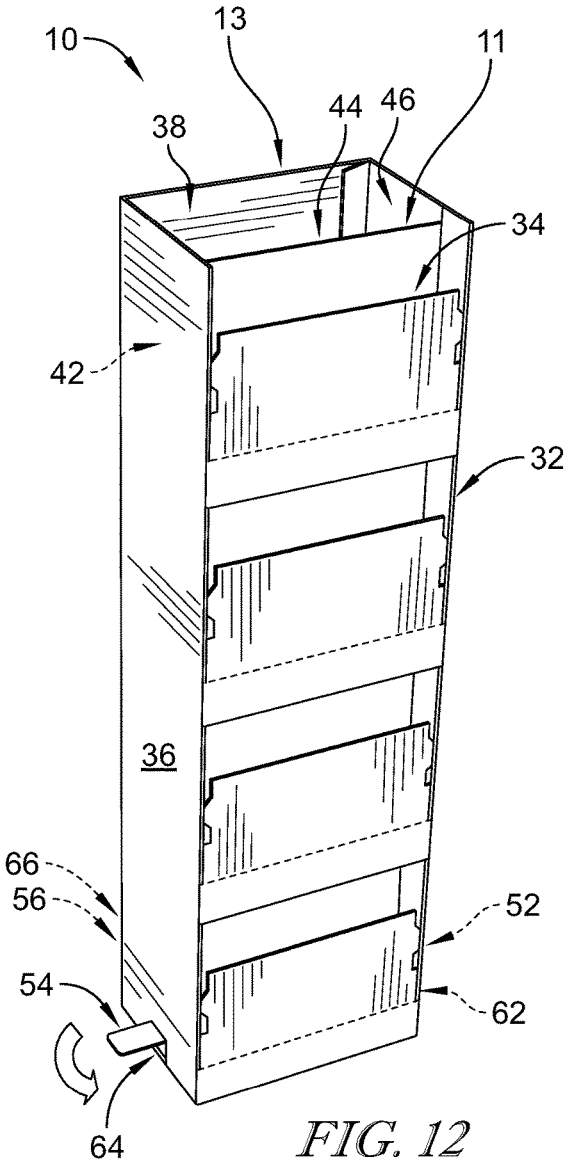
FIG. 12 is a front perspective view of the cabinet showing the cabinet in a partially assembled state with the insert received in the body and suggesting that lock tabs of the body fold relative to the body to be engaged with the insert as shown in FIGS. 13-14.
Figure 13:
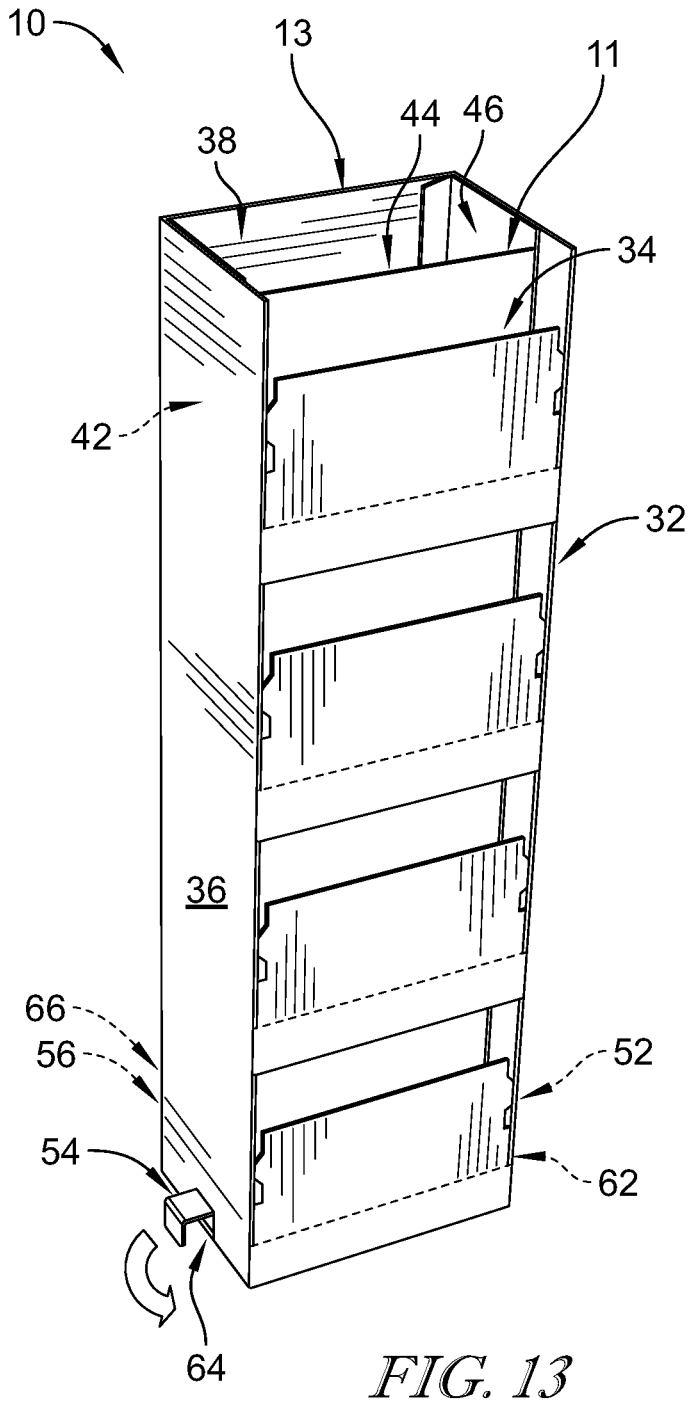
FIG. 13 is a view similar to FIG. 12 showing a left-side lock tab folded over and suggesting that the left-side lock tab is folded relative to the body to be received in the insert to hold the body on the insert.
Figure 14:
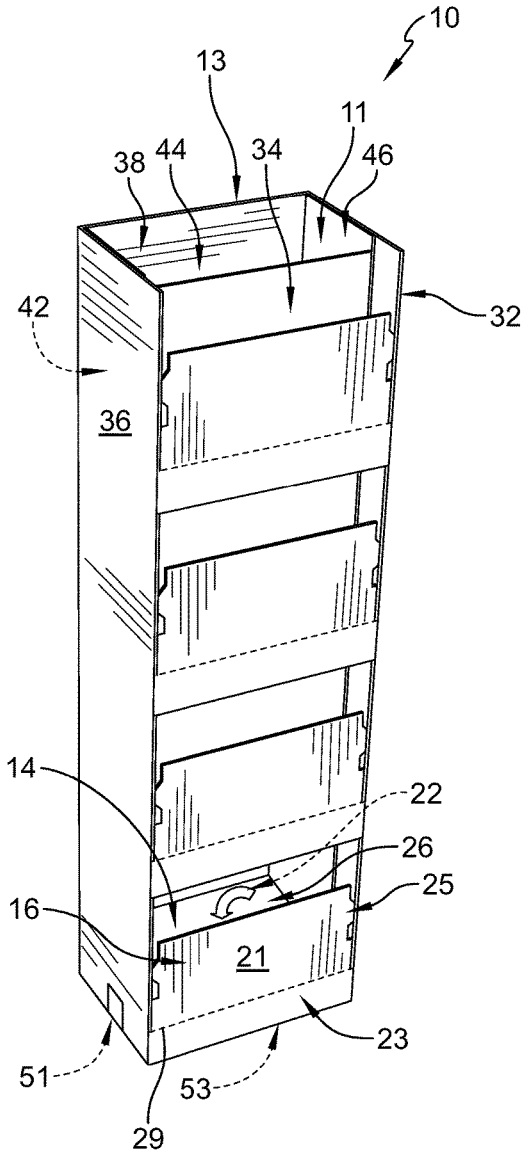
FIG. 14 is a view similar to FIG. 13 showing a lowest first shelf part folded relative to the body to at least partially form a shelf of the cabinet and suggesting that a support tab of the first shelf part engages with the bottom-closure flaps to at least partially support the first shelf part.
Figure 15:
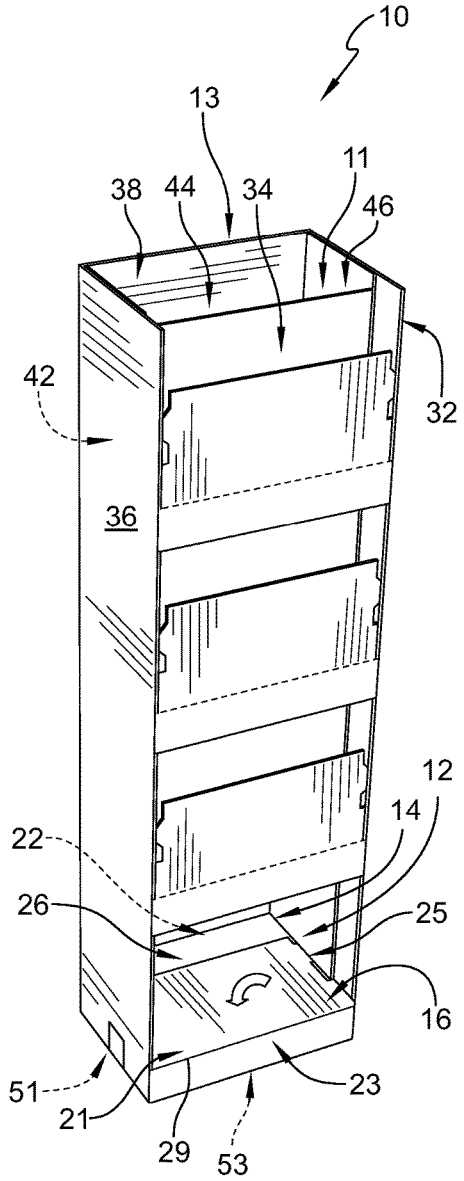
FIG. 15 is a view similar to FIG. 14 showing a lowest second shelf part folded relative to the body to engage with the first shelf part to form a shelf of the cabinet.

Body 13 is sized to receive insert 11 in an insert-receiving space defined by panels 32, 36, 38 and body shelf-part strip 34 as suggested in FIGS. 11 and 12. Insert 11 is configured to be received in body 13 such that spacer panels 42, 46 extend along sidewall panels 32, 36 and insert shelf-part strip 44 extends between sidewall panels 32, 36. In the illustrative embodiment, insert shelf-part strip 44 is generally parallel with body shelf-part strip 34 before folding of shelf parts 14, 16.

Spacer panels 42, 46 are configured to engage with back wall panel 38 to space insert shelf-part strip 44 apart from back wall panel 38 and apart from body shelf-part strip 34 as suggested in FIGS. 11 and 12. In some embodiments, insert shelf-part strip 44 spaced apart from body shelf-part strip 34 by about ¼ of a total distance between body shelf-part strip 34 and back wall panel 38. In some embodiments, spacer panels 42, 46 are sized such that insert shelf-part strip 44 of insert 11 is positioned in confronting relation with body shelf-part strip 34 of body 13. In some embodiments, spacer panels 42, 46 are sized such that insert shelf-part strip 44 of insert 11 is positioned closer to body shelf-part strip 34 of body 13 than back wall 38.

In one illustrative embodiment, insert blank 104 is formed to include retainer slots 62, 64 as shown in FIG. 3. Lock tabs 52, 54 are coupled to body blank 102, as shown in FIG. 2, and configured to engage with retainer slots 62, 64, as suggested in FIGS. 12-14 and 19, to hold body 13 on insert 11. A support tab 22 of a lowest first shelf part 14 is formed to define an indent 66, and each bottom-closure flap 51, 53 is formed to include a notch 69, as shown in FIG. 3. A lock tab 56 of body blank 102 is formed to include a notch 68, as shown in FIG. 2, and configured to pass through indent 66 to engage with notches 69, as suggested in FIGS. 12-14 and 19.

To form shelves 12, and finish assembly of cabinet 10, first and second shelf parts 14, 16 are folded as suggested in FIGS. 14-18. A lowest first shelf part 14 is folded relative to body 13 such that support tab 22 of first shelf part 14 engages with the bottom-closure flaps 51, 53 to at least partially support first shelf part 14 and to at least partially form a shelf 12 of the cabinet 10 as suggested in FIG. 14. A lowest second shelf part 16 is folded relative to body 13 about fold line 29 to engage with first shelf part 14 to form a lowest shelf 12 of cabinet 10 as suggested in FIG. 15. Wedges 25 of second shelf part 16 engage with insert 11 to retain second shelf part 16 in place relative to first shelf part 14.

Figure 16:
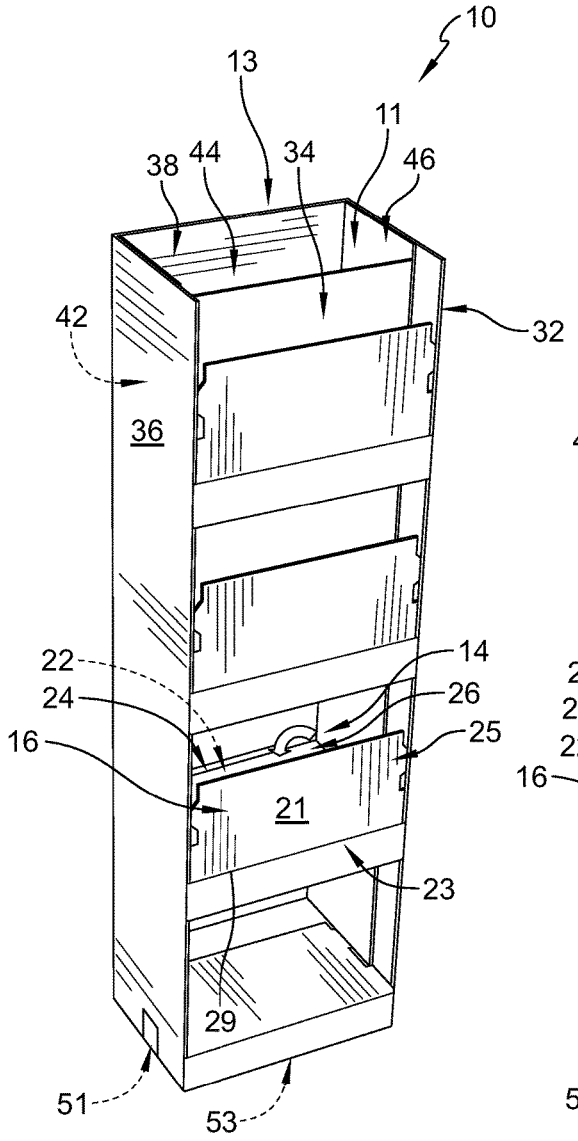
FIG. 16 is a view similar to FIG. 15 showing a next lowest first shelf part folded relative to the body to at least partially form another shelf of the cabinet and suggesting that a support tab of the first shelf part engages with a slot formed in the back wall panel to at least partially support the first shelf part.
Figure 17:
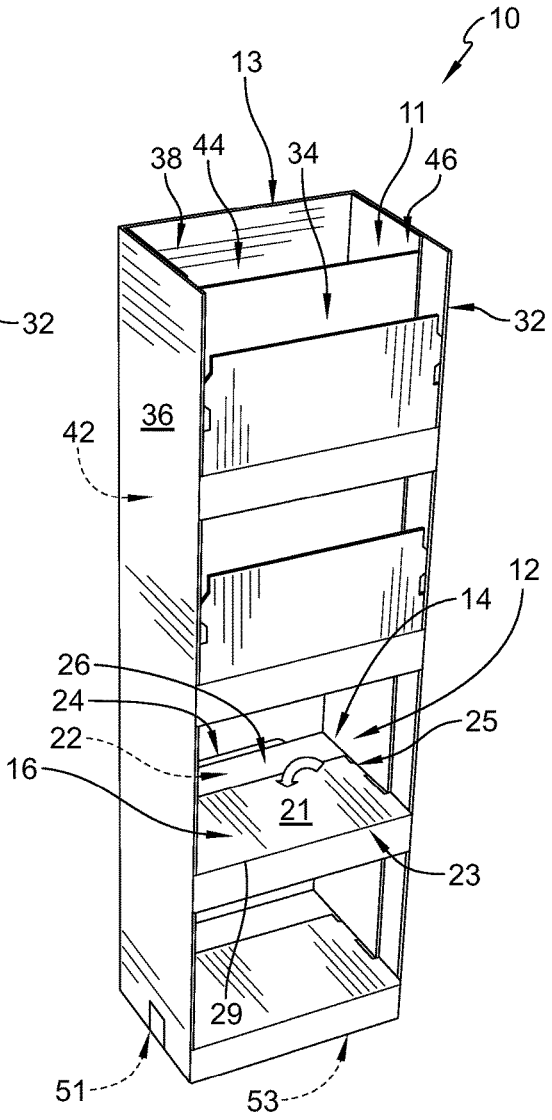
FIG. 17 is a view similar to FIG. 16 showing a next lowest second shelf part folded relative to the body to engage with the first shelf part to form another shelf of the cabinet.

A next lowest first shelf part 14 is folded relative to body 13 such that support tab 22 of first shelf part 14 engages with slot 24 formed in back wall panel 38 to at least partially support first shelf part 14 and to at least partially form another shelf 12 of the cabinet 10 as suggested in FIG. 16. A next lowest second shelf part 16 is folded relative to body 13 about fold line 29 to engage with first shelf part 14 to form another shelf 12 of cabinet 10 as suggested in FIG. 17. The remaining shelves are formed in a similar manner to assemble cabinet 10 as suggested in FIG. 18.

Bottom-closure flaps 51, 53 define a closed bottom of cabinet 10 as shown in FIG. 19. Support wall bands 28 of first shelf parts 14 form cross braces to support second shelf parts 16 and strengthen shelves 12. Front wall bands 23 collectively define a front wall of cabinet 10.

In another illustrative example, a body blank 202 and an insert blank 204 are folded and assembled together to form a cabinet in accordance with the present disclosure as suggested in FIGS. 20 and 21. Body blank 202 is similar to body blank 102, with at least one difference being that body blank 202 does not include lock tabs 52, 54, 56. Insert blank 204 is similar to insert blank 104, with at least one difference being that insert blank 204 does not include bottom closure flaps 51, 53. Similar reference numerals in the 200's are used in FIGS. 20 and 21 to identify similar components to those of blanks 102, 104 shown in FIGS. 2 and 3. A cabinet formed from body blank 202 and an insert blank 204 is supported on a surface such that lower portions rest on the surface, and support tab 222 of a lowest first shelf part 214 also rests on the surface to support first shelf part 214.

In another illustrative example, a body blank 302 and an insert blank 304 are folded and assembled together to form a cabinet in accordance with the present disclosure as suggested in FIGS. 22 and 23. Body blank 302 is similar to body blank 102, with at least one difference being that body blank 302 does not include lock tabs 52, 54, 56. Insert blank 304 is similar to insert blank 104, with at least one difference being that insert blank 304 does not include bottom closure flaps 51, 53. Similar reference numerals in the 300's are used in FIGS. 22 and 23 to identify similar components to those of blanks 102, 104 shown in FIGS. 2 and 3. In the illustrative embodiment, second shelf parts 316 of body blank 300 are elongated when compared to second shelf parts 16 of body blank 102. First shelf parts 314 and spacer panels 342, 346 of insert blank 304 are shortened compared to first shelf parts 14 and spacer panels 42, 46 of insert blank 104. Spacer panels 342, 346 of insert blank 304 are configured to position support wall bands 328 closer to a back wall panel 338 of a cabinet formed from body blank 302 and insert blank 304 than a front wall of the cabinet. In one example, the support wall bands 328 are spaced apart from the back wall panel 338 by about ¼ of the total distance between the front wall and the back wall panel 338. A cabinet formed from body blank 302 and insert blank 304 is supported on a surface such that lower portions rest on the surface, and support tab 322 of a lowest first shelf part 314 also rests on the surface to support first shelf part 314.

Figure 26:
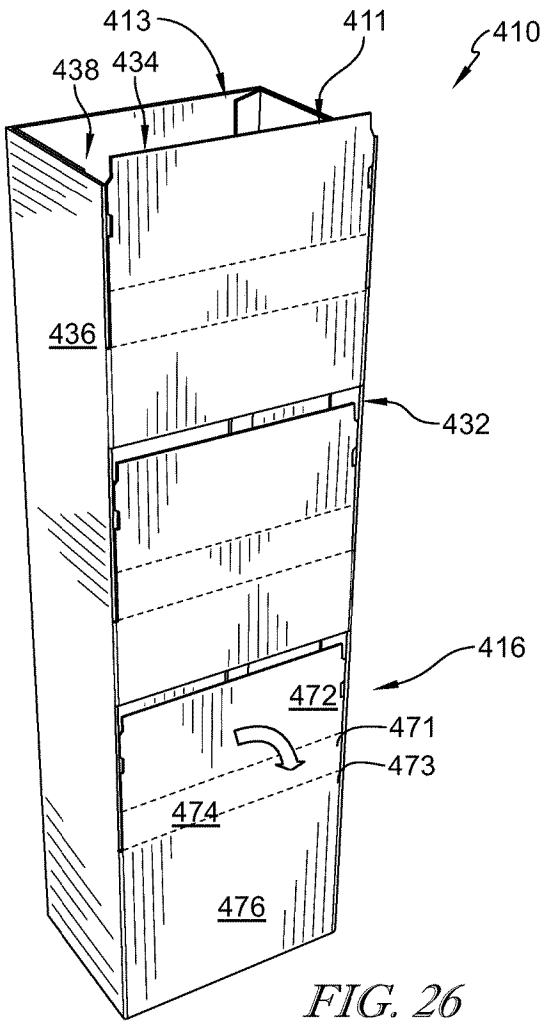
FIG. 26 is a front perspective view of a partially assembled cabinet formed from the erected blanks of FIGS. 24 and 25 showing the insert received in the body and suggesting that a second floor panel of a second shelf part folds along a first fold line relative to the body as shown in FIG. 27.
Figure 29:
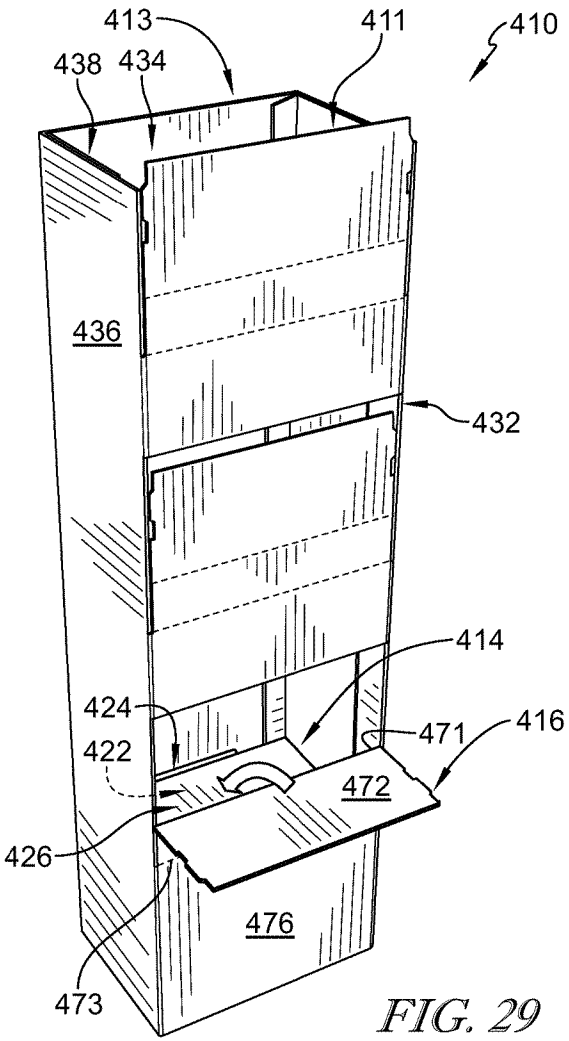
FIG. 29 is a view similar to FIG. 28 showing the support tab received in a slot of a the body to at least partially support the first shelf part and suggesting that the second floor panel folds relative to the body about a second fold line as shown in FIG. 30.
Figure 28:
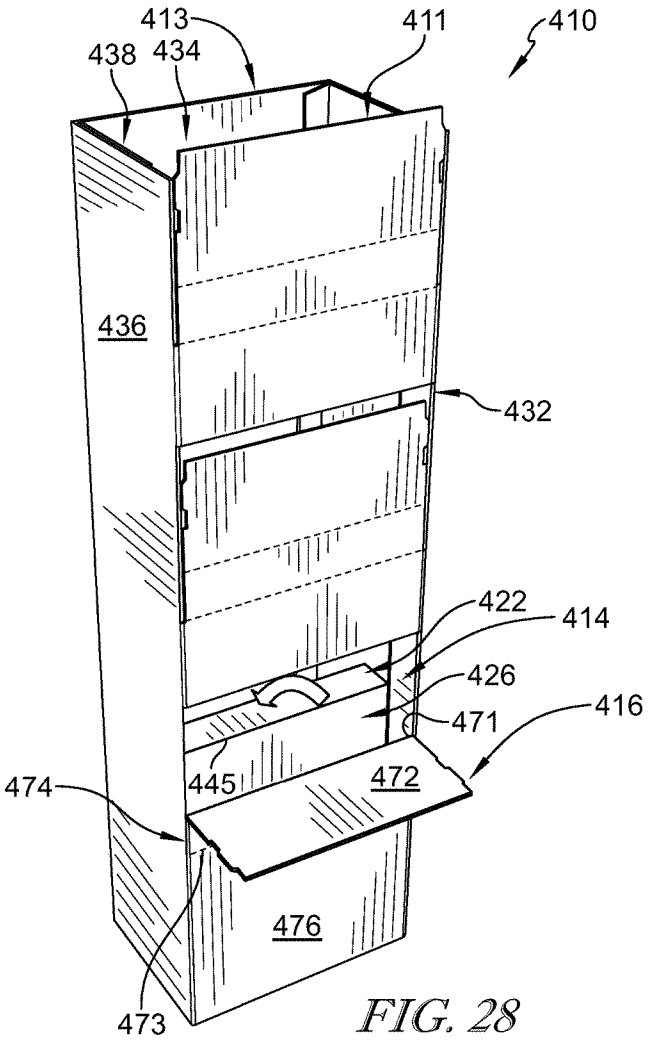
FIG. 28 is a view similar to FIG. 27 showing the support tab folded over and suggesting that the first floor panel folds relative to the body as shown in FIG. 29.

In another illustrative example, a body blank 402 and an insert blank 404 are folded and assembled together to form a cabinet 410 in accordance with the present disclosure as suggested in FIGS. 24-31. Insert 411 is received in body 413 as shown in FIG. 26. Each second shelf part 416 includes a second floor panel 472, a drop panel 474, and a front wall band 476 as. Second floor panel 472 folds relative to drop panel 474 about a fold line 471 as suggested in FIGS. 26 and 27. Support tab 422 of first shelf part 414 folds relative to first floor panel 426 about fold line 445, and first floor panel 426 folds relative to body 413 such that support tab 422 is received in slot 424 as suggested in FIGS. 27-29. Drop panel 474 is folded relative to body 413 about a fold line 473 to engage second floor panel 472 with first floor panel 426 as suggested in FIGS. 29 and 30. First and second shelf parts 414, 416 combine to form a recessed shelf 412 with a lip extending along fold line 473 to block product stored on shelf 412 from falling out of cabinet 410. The remainder of first and second shelf parts 414, 416 are folded to form shelves 412 and assemble cabinet 410 as suggested in FIG. 31.

The above descriptions of blanks 102, 104, 202, 204, 302, 304, 402, 404, and the cabinets formed thereby, can be equally applied to one another to incorporate the features thereof as desired.

Cabinets in accordance with the present disclosure minimize waste and maximize efficiency as a result of minimizing the components and steps for assembling the cabinets. Efficiency is further maximized as a result of the un-erected cabinet being formed without the use of specialty or custom equipment.

It is within the scope of the present disclosure to make blanks in accordance with the present disclosure from a variety of materials including corrugated paperboard, folding carton, solid fiber, plastic sheeting, plastic corrugated, combinations thereof, or any other suitable material. In illustrative embodiments, insert and body may be formed from the same or different materials.

In illustrative embodiments, the two pieces of a cabinet include a die cut glued tube and a die cut insert. The overlapping shelf parts of shelves maximizes strength of shelves to accommodate products of varying weights. For example, shelf may hold 25 pounds or more.

The invention claimed is:

1. A cabinet comprising a body including a body shelf-part strip, a back wall panel spaced apart from the body shelf-part strip, and sidewall panels extending between the body shelf-part strip and the back wall panel, the body shelf-part strip, back wall panel, and sidewall panels cooperating to define an insert-receiving space therebetween, and an insert being located in the insert-receiving space and including an insert shelf-part strip extending between the sidewall panels and located between the body shelf-part strip and the back wall panel and a pair of spacer panels coupled along opposing edges of the insert shelf-part strip, wherein the spacer panels are arranged to engage the back wall panel of the body and extend away from the back wall panel toward the body shelf-part strip to cause the insert shelf-part strip to be spaced apart from the back wall panel, the insert shelf-part strip is formed to define one or more first shelf parts arranged to extend from the insert shelf-part strip toward the back wall panel to couple with the back wall panel, and the body shelf-part strip is formed to define one or more second shelf parts arranged to extend from the body shelf-part strip toward the back wall panel and overlie at least a portion of the first shelf parts to establish one or more shelves of the cabinet.

2. The cabinet of claim 1, wherein the spacer panels are configured to position the insert shelf-part strip closer to the body shelf-part strip than the back wall panel.

3. The cabinet of claim 1, wherein the spacer panels are configured to position the insert shelf-part strip closer to the back wall panel than the body shelf-part strip.

4. The cabinet of claim 1, wherein each second shelf part includes a wedge arranged to extend toward at least one of the spacer panels and engage the spacer panel with an interference fit to limit movement of the second shelf part relative to the first shelf part.

5. The cabinet of claim 1, wherein the back wall panel is formed to include one or more slots, and wherein support tabs of the first shelf parts are received in the slots to at least partially support the first shelf parts.

6. The cabinet of claim 5, wherein each first shelf part includes a support wall band coupled to the spacer panels, a first floor panel coupled to the support wall band and foldable relative to the support wall band, and the support tab coupled to an opposing end of the first floor panel from the support wall band and foldable relative to the first floor panel.

7. The cabinet of claim 6, wherein each second shelf part includes a front wall band coupled to the sidewall panels and a second floor panel coupled to the front wall band and foldable relative to the front wall band, and wherein the support wall bands are configured to provide a cross brace to support the second floor panels.

8. The cabinet of claim 6, wherein each second shelf part includes a front wall band coupled to the sidewall panels, a drop panel coupled to the front wall band and foldable relative to the front wall band along a fold line, and a second floor panel coupled to the drop panel and foldable relative to the drop panel, wherein the drop panel is configured to space the second floor panel away from the fold line to form a lip along the fold line, and wherein the support wall bands are configured to provide a cross brace to support the second floor panels.

9. The cabinet of claim 1, wherein the insert further includes bottom-closure panels coupled to the spacer panels and configured to provide a closed bottom of the cabinet.

10. The cabinet of claim 9, wherein the body further includes a lock tab, the insert further includes a retention slot, and the retention slot is configured to receive the lock tab to hold the body on the insert.

11. The cabinet of claim 9, wherein a support tab of one of said first shelf parts engages with the bottom-closure panels to at least partially support the first shelf part.

12. A cabinet comprising a body blank including a body shelf-part strip, sidewall panels coupled along opposing edges of the body shelf-part strip, and a back wall panel coupled along an edge of one of the sidewall panels, and an insert blank including an insert shelf-part strip and a pair of spacer panels coupled along opposing edges of the insert shelf-part strip, wherein the body blank is foldable to attach the back wall panel to the other of said sidewall panels and form a body of the cabinet, the insert blank is foldable to form an insert of the cabinet, the body is sized to receive the insert therein, the insert shelf-part strip is formed to define one or more first shelf parts arranged to extend from the insert shelf-part strip toward the back wall panel to couple with the back wall panel, and the body shelf-part strip is formed to define one or more second shelf parts arranged to extend from the body shelf-part strip toward the back wall panel and overlie at least a portion of the first shelf parts to establish one or more shelves of the cabinet.

13. The cabinet of claim 12, wherein the spacer panels are arranged to engage the back wall panel of the body and extend away from the back wall panel toward the body shelf-part strip to cause the insert shelf-part strip to be spaced apart from the back wall panel.

14. The cabinet of claim 12, wherein each second shelf part includes a wedge arranged to extend toward at least one of the spacer panels and engage the spacer panel with an interference fit to limit movement of the second shelf part relative to the first shelf part.

15. The cabinet of claim 12, wherein the back wall panel is formed to include one or more slots, and wherein support tabs of the first shelf parts are received in the slots to at least partially support the first shelf parts.

16. The cabinet of claim 15, wherein each first shelf part includes a support wall band coupled to the spacer panels, a first floor panel coupled to the support wall band and foldable relative to the support wall band, and the support tab coupled to an opposing end of the first floor panel from the support wall band and foldable relative to the first floor panel.

17. The cabinet of claim 16, wherein each second shelf part includes a front wall band coupled to the sidewall panels and a second floor panel coupled to the front wall band and foldable relative to the front wall band, and wherein the support wall bands are configured to provide a cross brace to support the second floor panels.

18. The cabinet of claim 16, wherein each second shelf part includes a front wall band coupled to the sidewall panels, a drop panel coupled to the front wall band and foldable relative to the front wall band along a fold line, and a second floor panel coupled to the drop panel and foldable relative to the drop panel, wherein the drop panel is configured to space the second floor panel away from the fold line to form a lip along the fold line, and wherein the support wall bands are configured to provide a cross brace to support the second floor panels.

19. The cabinet of claim 12, wherein the insert further includes bottom-closure panels coupled to the spacer panels and configured to provide a closed bottom of the cabinet.

20. The cabinet of claim 19, wherein the body further includes a lock tab, wherein the insert further includes a retention slot, and wherein the retention slot is configured to receive the lock tab to hold the body on the insert.

* * * * *